US006662800B2

(12) United States Patent
Yeung

(10) Patent No.: US 6,662,800 B2
(45) Date of Patent: Dec. 16, 2003

(54) RANGE HOOD FAN SPRAY DISPENSER

(75) Inventor: Peter Yeung, 4446 Francis Street, Burnaby, British Columbia (CA), V5Z 2R4

(73) Assignee: Peter Yeung, Burnaby (CA)

( * ) Notice: Subject to any disclaimer, the term of this patent is extended or adjusted under 35 U.S.C. 154(b) by 0 days.

(21) Appl. No.: 10/226,879

(22) Filed: Aug. 22, 2002

(65) Prior Publication Data

US 2003/0037782 A1 Feb. 27, 2003

(30) Foreign Application Priority Data

Aug. 26, 2001 (CN) ..... 01255367 U
May 31, 2002 (CA) ..... 2388390

(51) Int. Cl.[7] ..... F24C 15/20

(52) U.S. Cl. ..... 126/299; 126/299 D; 134/167 C; 55/DIG. 36

(58) Field of Search ..... 126/299 R, 299 D, 126/299 E; 454/49, 56, 61, 62, 57, 354, 341; 96/228, 233; 415/121.3; 55/DIG. 36; 134/115, 167 R, 167 C

(56) References Cited

U.S. PATENT DOCUMENTS

| | | | | |
|---|---|---|---|---|
| 2,539,344 A | | 1/1951 | Carraway | |
| 3,490,206 A | | 1/1970 | Doane | |
| 3,563,005 A | | 2/1971 | Jones | |
| 3,616,744 A | | 11/1971 | Jensen | |
| 3,795,181 A | | 3/1974 | Lawson | |
| 4,085,735 A | | 4/1978 | Kaufman et al. | |
| 4,231,765 A | | 11/1980 | Scott | |
| 4,231,769 A | | 11/1980 | Ahlrich | |
| 4,259,945 A | | 4/1981 | Lawson | |
| 4,363,642 A | | 12/1982 | Stahl | |
| 4,753,218 A | | 6/1988 | Potter | |
| 5,069,197 A | | 12/1991 | Wisting | |
| 5,158,429 A | * | 10/1992 | Chiang | 126/299 E |
| 5,235,963 A | | 8/1993 | Strause | |
| 5,323,762 A | * | 6/1994 | Chiang | 126/299 E |
| 5,469,837 A | * | 11/1995 | Chiang | 126/299 R |
| 5,662,097 A | | 9/1997 | Panos | |
| 5,755,214 A | | 5/1998 | Lai | |
| 6,125,841 A | | 10/2000 | Boudreault | |
| 6,223,741 B1 | | 5/2001 | Panos | |

FOREIGN PATENT DOCUMENTS

| | | |
|---|---|---|
| CN | 2289156 | 8/1998 |
| GB | 2138127 A | 11/1984 |
| GB | 2139750 A | 11/1984 |

* cited by examiner

*Primary Examiner*—James C. Yeung
(74) *Attorney, Agent, or Firm*—Glenn Patent Group; Michael A. Glenn

(57) ABSTRACT

A spray dispenser for a range hood having a motor housing and at least one motor, fan and grease tray. The spray dispenser is positioned externally to the motor housing and directs a spray of cleaning fluid at the fan and into the motor housing. The spray dispenser has a nozzle, a hose and a source of cleaning fluid. The nozzle may be releasably connected to either the motor housing or to the tray. If the nozzle is connected to the motor housing, the tray must be dimensioned to accommodate the nozzle when the tray is connected to the motor housing. Alternatively, if the nozzle is connected to the tray, it may extend through apertures in the tray or be connected to the bottom of the tray. The nozzle may be equipped with a drip catcher to ensure that no cleaning fluid drips on the cooking surface below.

8 Claims, 8 Drawing Sheets

RANGE HOOD FAN SPRAY DISPENSER

FIELD OF THE INVENTION

This invention relates to range hoods and more particularly to a spray dispenser for a range hood wherein a cleaning fluid is dispersed against the surfaces of a range hood fan in order to remove any accumulated grease from the fan.

BACKGROUND OF THE INVENTION

Range hoods are used above cooking surfaces to remove grease, common odors and hazardous gases created during the cooking process. Typically, range hoods have a pair of motors horizontally installed in a motor housing within the hood body. Each motor drives a fan. The fans draw air from the cooking area below and force it through the motor housing to ventilation piping.

As the vaporized grease contained in the entrained air travels through the motor housing, some of it condenses on the inside walls of the housing from where the shaping of the walls and floor of the housing directs the grease to a circular grease catcher mounted below each fan opening. Grease catchers are known in the art as illustrated in U.S. Pat. Nos. 6,216,686 B1 and 5,537,988.

Grease catchers are also adapted to capture any grease that drips off the fan blades when the motors are turned off. Typically, the grease catcher has radial inner and outer trays with a wall separating them. The wall extends vertically so as to be almost flush with the lower edge of the outer circumference of the fan. In this way air being drawn in by the fans is compelled to enter the motor housing rather than the hood body. The wall therefore acts to control the air currents of the range hood.

The grease catchers are usually provided with an inclined base or floor, so as to direct accumulated grease to a hole in the floor. A hose is attached to the hole to convey the grease to a grease receptacle outside the range hood.

The motor housing and grease catchers are mounted within the hood body. Openings in the lower surface of the hood body are positioned so as to match those of the motor housing. Typically the lower surface of the hood body is removably fitted into the main hood body. A protective grill is attached to the outside of each opening in the hood body so as to prevent the insertion of body parts when the fan is in operation.

Alternatively, as set out in my U.S. and Canadian patent applications, numbers 10/035,116 and 2,365,790 respectively, the motor housing may be adapted to act as a grease catcher itself. In this system, a circular wall defining the motor housing intake openings projects vertically into the motor housing, acting as a barrier to grease accumulated therein. The accumulated grease drains directly from the housing rather than to a grease catcher. Grease trays inserted into the intake openings provide a barrier for proper airflow into the housing and to capture any grease that should happen to drip from the fan.

Both of the foregoing designs rely on gravity to cause the accumulated grease to drain out of the range hood. However, gravity is not effective in removing all the grease with the result that some becomes caked on to the interior surfaces, thereby reducing the efficiency of the range hood. The foregoing systems of motor housing and grease catchers therefore require periodic cleaning to remove condensed grease accumulated on the fans, motor housing interior and grease catchers or trays.

Attempts have been made to overcome the necessity to manually clean the interior of a range hood exhaust system. It is known in the art to provide a washing fluid under pressure in order to clean the interior of the exhaust system. For example, U.S. Pat. No. 4,259,945 teaches an exhaust system in which a washing fluid under pressure is used to clean the flue and fan. Cleaning of the fan is possible as it is set back in the exhaust duct and is positioned such that fluid sprayed on the fan drains to an external receptacle. Similar washing fluid systems are taught in U.S. Pat. Nos. 3,795,181 and 4,085,735. However, these prior art cleaning systems are specific to their respective range hood/exhaust duct designs.

A cleaning system is also known in the art with respect to the range hood having a motor housing as described above. A fluid delivering nozzle is fitted into a hole in the side of the motor housing so as to deliver a spray of washing fluid to clean the interior. This is done while the motors are activated so that the force of the air being drawn into the motor housing forces the sprayed fluid against the interior surfaces of the motor housing and prevents any liquid from passing through the air intakes. However, while this system cleans the interior of the motor housing, it does not clean the fan.

It is therefore an object of an embodiment of the present invention to provide a spray dispenser for cleaning a fan in a range hood having a motor housing with at least one fan.

Other objects of the invention will be apparent from the description that follows.

SUMMARY OF THE INVENTION

According to the present invention there is provided a spray dispenser for use in a range hood comprising a motor housing having an interior and containing at least one motor and at least one fan, and a grease tray releasably attachable to the motor housing. The spray dispenser comprises a nozzle, a hose, and at least one source of cleaning fluid located externally to the motor housing. The nozzle is positioned so as to disperse cleaning fluid from the source of cleaning fluid against the fan and into the motor housing interior.

In one aspect of the invention, the nozzle and hose are located external to the motor housing.

In another aspect of the invention, the grease tray comprises an opening, first, second and third tray walls extending around the opening, a first trough formed between the first and second tray walls, a second trough formed between the second and third tray walls, and at least one drainage hole. Preferably, the nozzle extends through apertures in at least two of said first, second and third tray walls;

In another aspect of the invention the nozzle has a drip catcher. Preferably the drip catcher is seated in the first trough.

In an alternative embodiment of the invention, the grease tray comprises an opening, first and second tray walls extending around the opening, and a trough formed between the walls.

In another aspect of the invention, the nozzle is releasably connectable to the grease tray.

In another aspect of the invention, the grease tray further comprises a gap in the first and second tray walls, and is sized such that the nozzle may be positioned within the gap.

In another aspect of the invention the motor housing has a lower surface having at least one intake opening and at least one drain hole. The intake opening is defined by a wall depending from the lower surface of the motor housing and projecting into the interior of the enclosure. The tray comprises an opening, first and second tray walls extending around the opening, and a floor between the first and second tray walls. The nozzle is releasably connectable to the tray and the tray is releasably connectable to the intake opening.

The present invention is also directed a spray dispenser for use in a range hood generally defining an enclosure and comprising an upper panel and a lower panel, the lower panel having at least one air inlet and having a motor housing and tray. The motor housing is connectable to the range hood within the enclosure of the range hood. The motor housing generally defines a further enclosure and comprises a lower surface having at least one intake opening and at least one drain hole. A wall depending from the lower surface and projecting into the interior of the further enclosure defines the intake opening. The spray dispenser comprises a nozzle, a hose, and at least one source of cleaning fluid located externally to said motor housing. The nozzle being positioned so as to disperse cleaning fluid from the source of cleaning fluid against the fan and into the motor housing interior.

In another aspect of the invention, the tray comprises an opening, first and second tray walls extending around the tray opening and a trough formed between the walls; and the tray is releasably connectable to the intake opening;

In yet another aspect of the invention, the air inlet is defined by a third wall depending from the lower panel and projecting into the interior of the range hood enclosure. The air inlet and the intake opening are of identical shape, the air inlet being located directly below the intake opening. The tray may be releasably inserted into the air inlet and connected to the intake opening.

In another aspect of the invention the tray further comprises a gap in the first and second tray walls. The gap is sized such that the nozzle may be seated within the gap when the tray is inserted into the air inlet and connected to the intake opening.

Other aspects of the invention will be appreciated by reference to the detailed description of the preferred embodiment and to the claims that follow.

BRIEF DESCRIPTION OF THE DRAWINGS

These and other features of the invention will become more apparent from the following description in which reference is made to the appended drawings wherein.

DETAILED DESCRIPTION OF THE PREFERRED EMBODIMENT

Figure 1:
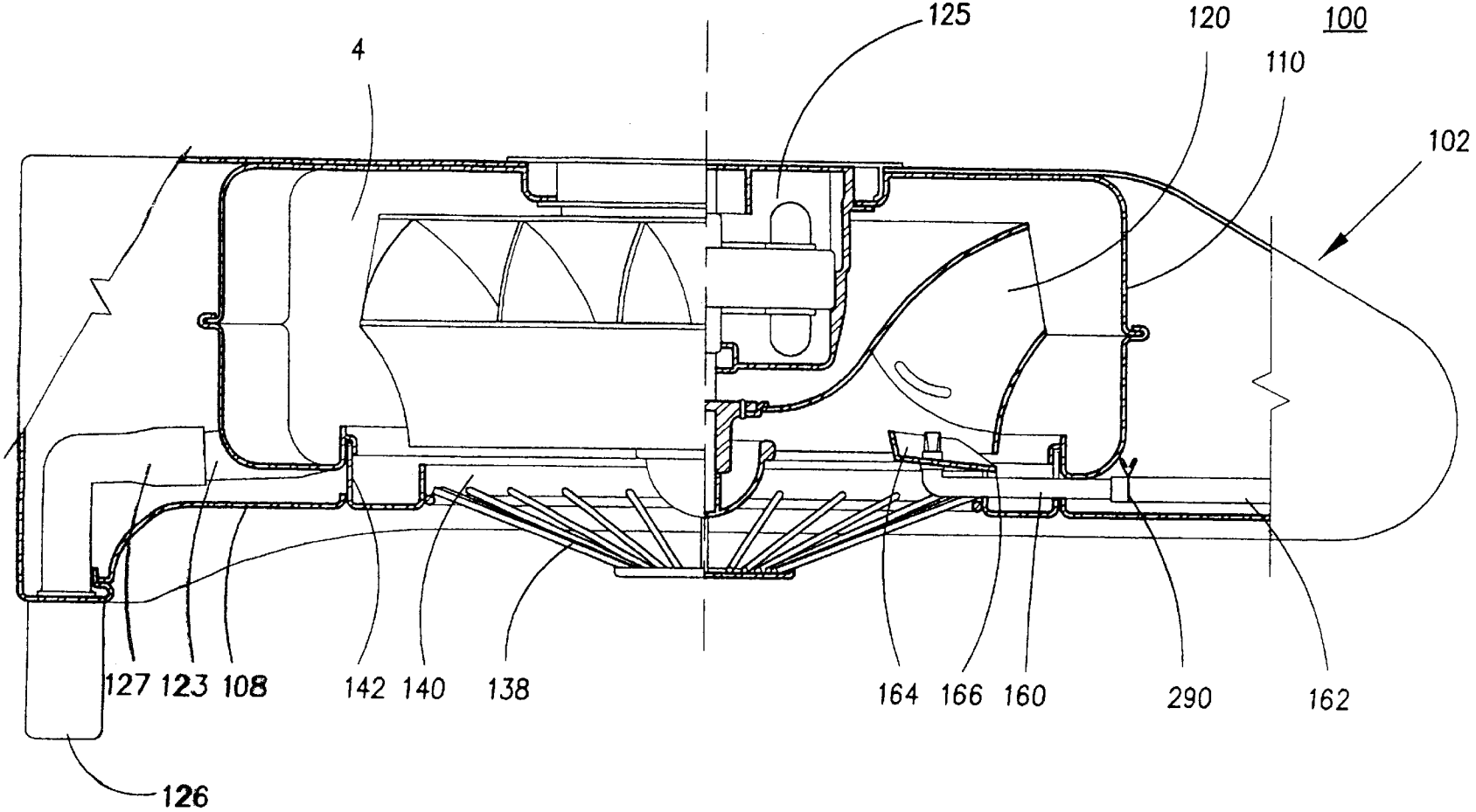
FIG. 1 is a sectional view of a range hood according to the preferred embodiment of the invention with the right hand portion of the figure providing a deeper sectional view than the left hand portion of the figure.

The preferred embodiment of a range hood 100 with a spray dispenser according to the invention is illustrated in FIG. 1. The spray dispenser is connected to a source of cleaning fluid. A pump forces the cleaning fluid to the spray dispenser where it is dispersed against grease coated surfaces of the range hood fans. This will be described in greater detail below by reference to the preferred and alternative embodiments.

In the preferred embodiment, the motor housing 110 defines an enclosure and is mountable within a further enclosure formed by the hood body generally indicated by the numeral 102. The interior of the housing 110 may be coated with a non-stick material so as to facilitate grease removal and is separated into two substantially similar, separate chambers 4, one of which is visible in FIG. 1. Each chamber 4 has an intake opening 112 and ventilation hole (not shown). The ventilation holes project through the upper surface of hood body 102 when the housing 110 is attached to the interior of the hood body 102.

A motor 125 is fitted in each chamber 4 of the motor housing 110 and is attached to the inside of the upper surface of the hood body 102. A fan 120, of the semi-impeller type, is secured to each of the motors 125 by fan caps 129, acts to draw grease-laden air into the motor housing 110 and out the ventilation holes. The fans 120 are dimensioned so as to be removable from within the housing 110 through openings 112.

The motor housing 110 acts as an integral grease catcher and includes walls 130 depending and rising vertically from the lower surface of the motor housing in each chamber 4. An outwardly and downwardly projecting extension or lip 132 depends from wall 130, so as to form a gap 134 between the lip 132 and wall 130. Extension 132 may diverge from wall 130 such that gap 134 forms a wedge surface. A tray 140 is dimensioned such that its outer wall 142 may be releasably connected to gap 134. This is discussed in greater detail below.

The lower surfaces of the chambers 4 of the motor housing 110 are each shaped such that any accumulated grease or other liquid is directed by gravity towards their respective drain holes 123 as shown in FIG. 1. Holes 123 are therefore located at the lowest point of lower surface 118 of the motor housing 110. As seen in FIG. 1, a drainage hose 127 is attached to each hole 123 (only one is visible). Accumulated liquid travels through drainage hoses 127 by way of gravity to external grease cups 126 (only one of which is shown in FIG. 1). Wall 130 acts as a barrier to any liquid that accumulates in the interior of the motor housing, preventing it from dripping through openings 112.

Figure 2:
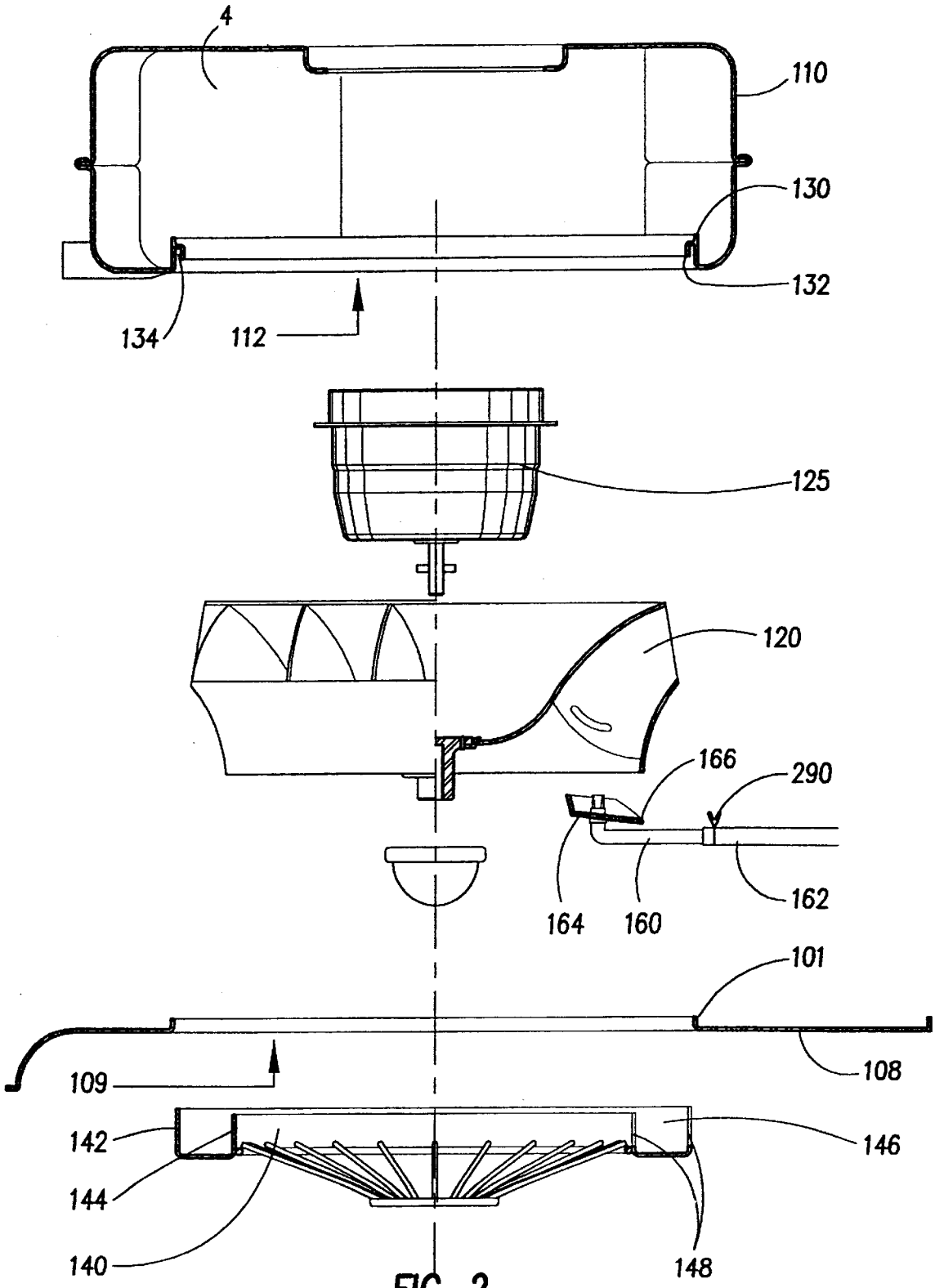
FIG. 2 is an exploded sectional view of portions of the range hood of FIG. 1.

As illustrated in FIGS. 1 and 2, for each chamber 4 the spray dispenser includes a hose 162 connected at one end to nozzle 160 and at the other end to a pump (not shown) through which cleaning fluid is pumped. Preferably nozzle 160 is equipped with a drip catcher 164. The nozzle 160 is positioned so as to disperse a spray solution against the fans 120 so as to force grease accumulated on the fans 120 into the chambers 4 of the motor housing 110. Preferably, the nozzle 160 is releasably connectable to a surface of the motor housing 110. Once nozzle 160 is connected to the motor housing, hose 162 may be releasably attached to the nozzle by way of crip 290 or other means.

The tray 140 while also being releasably connectable to housing 110, also connects to the lower panel 108, which is removable from the remainder of main hood body 102. Lower panel 108 has a pair of air inlets 109, one of which is shown in FIG. 2. Air inlets 109 are defined by circular vertical walls 101, which depend, and rise vertically from, lower panel 108. The circular vertical walls 101 can vary in height between a minimum height and a maximum height. The minimum height is the height at which the circular vertical walls 101 will remain in contact with the tray 140 when it is connected to the housing 110 as described below. The maximum height is the height at which the top of the circular vertical walls 101 abuts the bottom of the nozzle 160 when the lower panel 108 is connected with hood body 102.

Tray 140 has a fan grill 138 and is connected to the range hood 100 by inserting it through intake opening 109 in lower panel 108 and into intake opening 112 in the motor housing 110 until outer wall 142 is firmly in place within gap 134. Tray 140 may be releasably connected to housing 110 by wedging outer wall 142 into gap 134. When connecting the tray 140, it must be positioned so as to line-up gap 148 (shown in FIG. 2) formed in the tray walls 144, 142 with nozzle 162 such that the nozzle is seated, preferably tightly, within the gap 148. When tray 140 is connected to the housing 110, outer wall 142 is also in contact with lower panel 108 and acts to seal any space that may exist between the housing and the lower panel thereby preventing air from entering into any undesired area within the range hood body 102. A clip or other form of suitable restraint (not shown) accessible on the outside surface of the range hood is used to hold the tray in place. In this way, lower panel 108 need not be removed in order to access the interior of the motor housing 110. A user need simply remove the tray in order to access the interior of the housing.

Preferably, the nozzles are made of plastic. However, any solid material with suitable characteristics may be used. Drip catcher 164 is preferably made of plastic or rubber and is dimensioned such that when tray 140 is in place, drainage end 166 sits within the confines of trough 146 of the tray 140. Drip catcher 164 is set at a downward angle, drainage end 166 being lower than the remainder of the drip catcher. Any cleaning fluid dripping from nozzle 160 is caught by drip catcher 164 where it drains into trough 146 where it eventually evaporates or is removed during regular maintenance.

It is contemplated that the spray dispenser will be used in conjunction with the cleaning system of the prior art wherein cleaning fluid is sprayed into the motor housing 110 through the sides of the motor housing.

Figure 3:
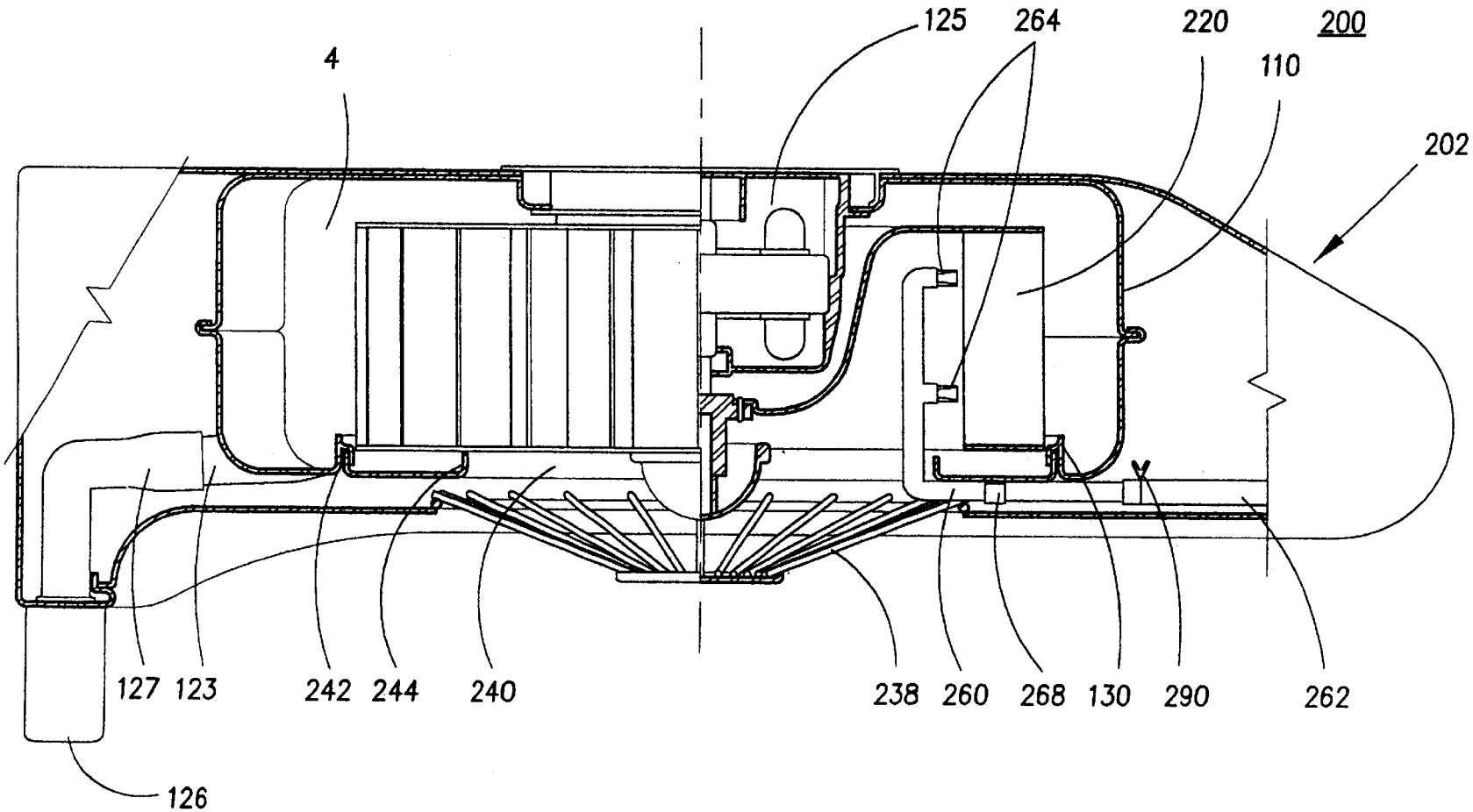
FIG. 3 is a sectional view of a range hood according to an alternative embodiment of the invention with the right hand portion of the figure providing a deeper sectional view than the left hand portion of the figure.
Figure 4:
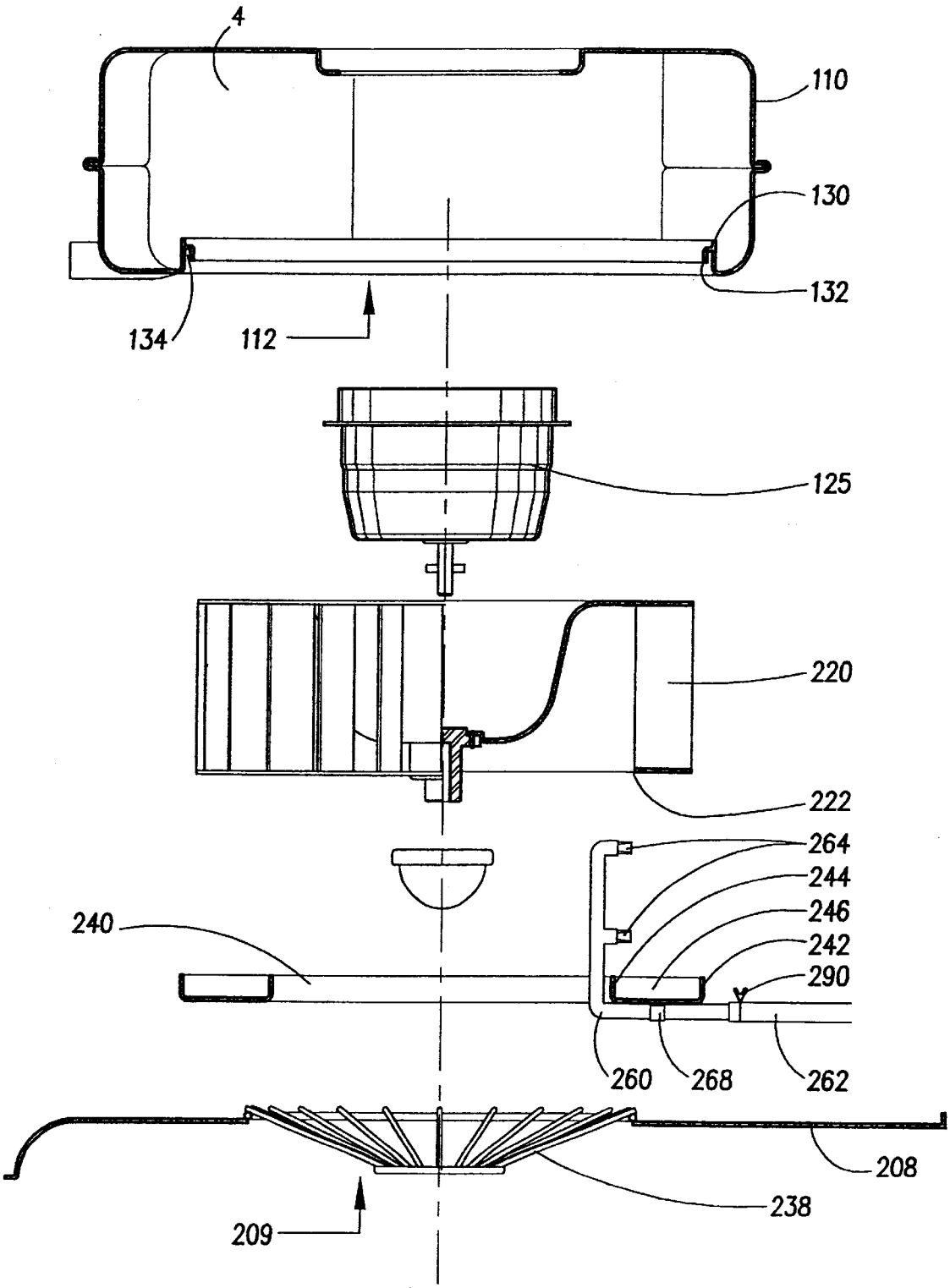
FIG. 4 is an exploded sectional view of portions of the range hood of FIG. 3.

An alternative embodiment is shown in FIGS. 3 and 4. Range hood 200 has motor housing 110 within hood body 202. In this embodiment fan 220 is of the squirrel cage type and is attached to motor 125. In order to remove grease from the fan 220, a nozzle 260 is used. At one end nozzle 260 has twin heads 264 for greater dispersion of cleaning fluid against the fan 220; however, any number of heads is satisfactory provided there is at least one. One end of a hose 262 is attached to nozzle 260, while the other end of hose 262 is attached to a pump (not shown).

Range hood 200 also has a different tray 240 and lower panel 208 design. In this embodiment, tray 240 has inner wall 244 and concentric outer wall 242. Inner wall 244 defines an opening. Outer wall 242 is distal from the opening in relation to the inner wall 244. Outer wall 242 is shaped and dimensioned to fit within gap 134 when tray 240 is connected with housing 110 so that a portion of outer wall 142 is in abutment with wall 130. Preferably, the diameter of inner wall 244 is smaller than the diameter of lower fan edge 222. The tray 240 is dimensioned such that when connected with the motor housing 110, the top of inner wall 244 is just below the level of fan 220, thereby directing air into the housing 110 by way of the fan 220.

Nozzle 260 may be releasably or permanently attached to tray 240, for example by connector 268, such that when the tray is connected to motor housing 110, hose 260 may then be attached to nozzle 262. Connection means such as a crip 290 are used to connect hose 262 to one end of nozzle 260. It is contemplated that other methods of connection would be equally viable. Cleaning fluid is pumped through hose 262 and is dispersed over a wide area by nozzle 260 against fan 220 thereby forcing any accumulated grease into the interior of the motor housing 110. Because the twin heads 264 are situated overtop of trough 246, any cleaning fluid that should happen to drip from them will land in tray 240 where it eventually evaporates or is removed during regular maintenance.

In order to access the interior of the range hood, one must remove lower panel 208, which has integrated fan grill 238 to prevent insertion of objects into the fan 220.

Figure 5:
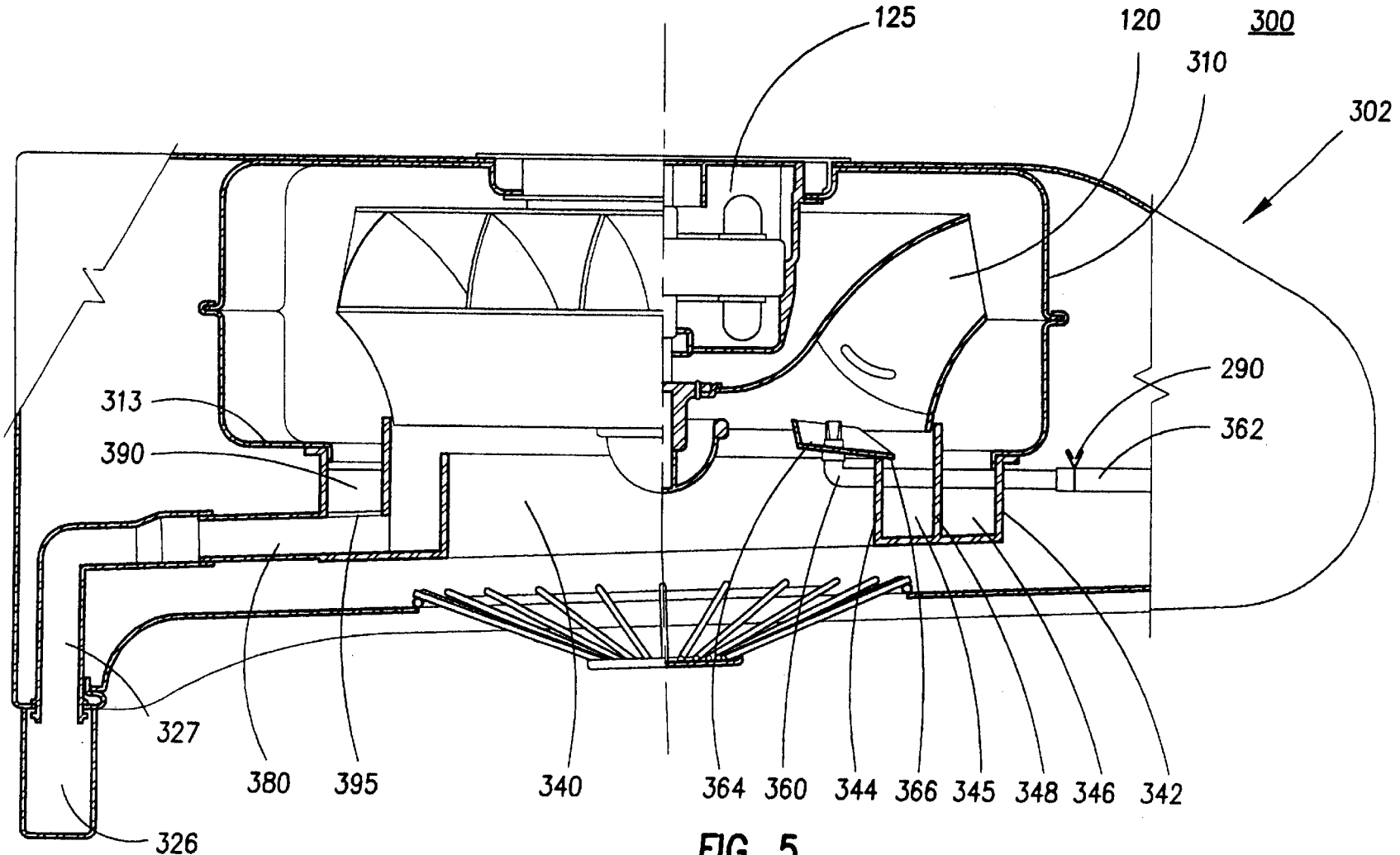
FIG. 5 is a sectional view of a further alternative embodiment of a range hood according to the invention with the right hand portion of the figure providing a deeper sectional view than the left hand portion of the figure.

A further alternative embodiment of a range hood 300 is shown in FIG. 5. Enclosed in hood body 302, motor housing 310 is compartmentalized in a similar fashion to the housing 110 of the preferred embodiment. However, the lower surface 313 of motor housing 310 is shaped such that grease accumulated in the housing interior drains into tray 340.

Figure 6:
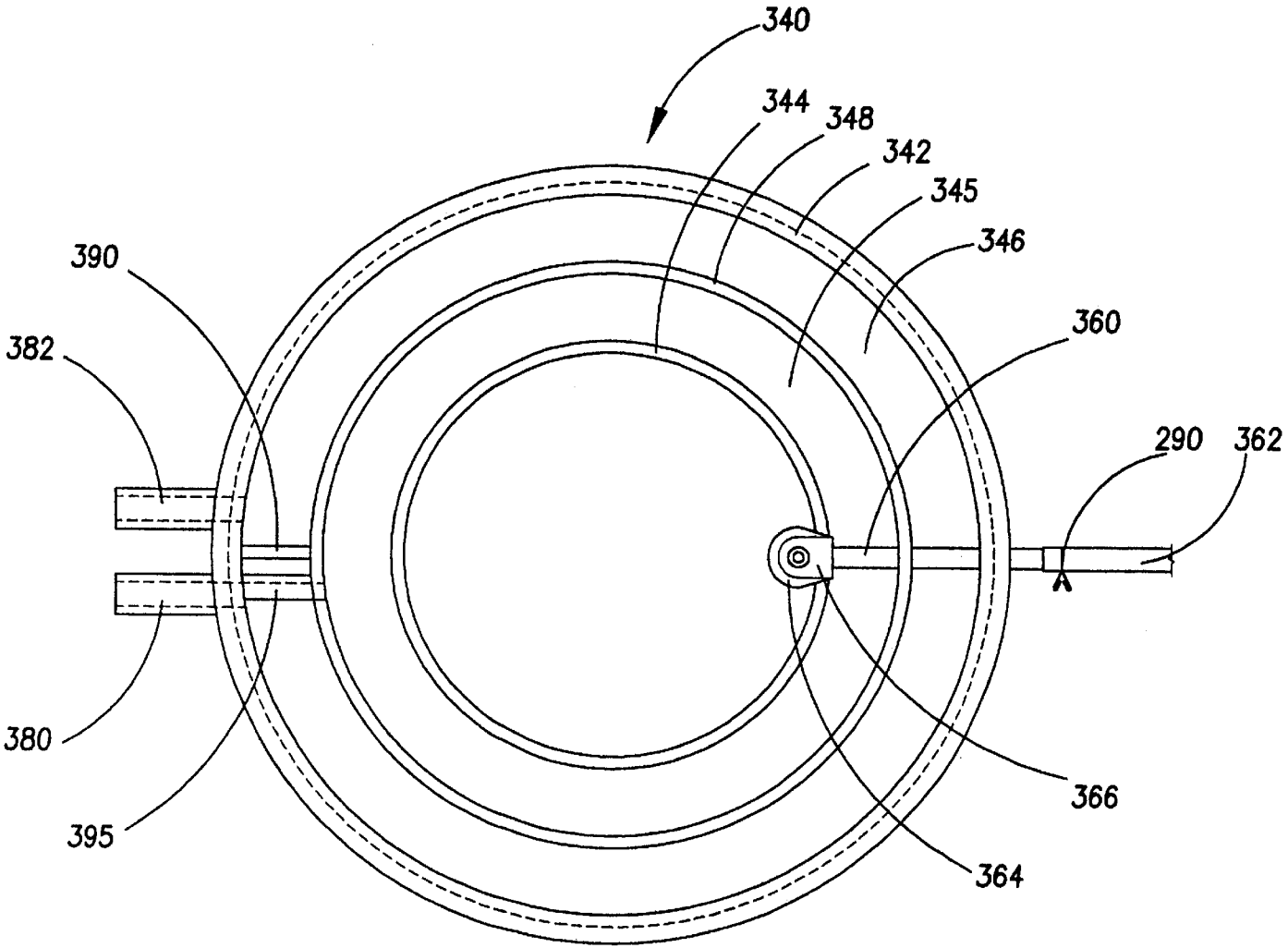
FIG. 6 is a top plan view of the grease tray of the range hood of FIG. 5.
Figure 7:
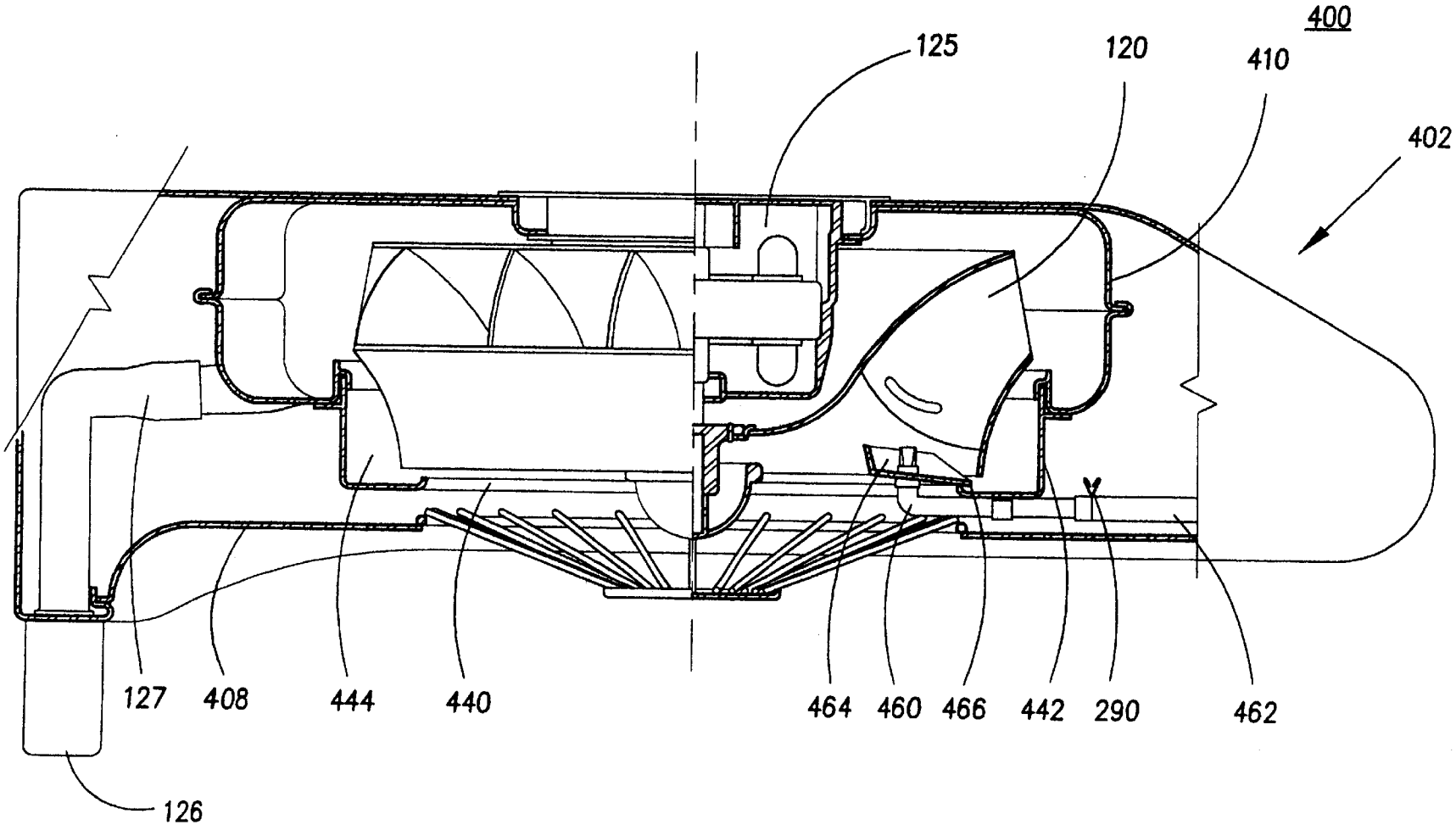
FIG. 7 is a sectional view of a further alternative embodiment of a range hood according to the invention with the right hand portion of the figure providing a deeper sectional view than the left hand portion of the figure.

An integrated fan nozzle 360 passes through apertures in each of walls 342, 348 and 344 as shown in FIGS. 5 and 6. Hose 362 attached to a pump (not shown) may be releasably attached to the fan nozzle 362 by way of crip 290. Cleaning fluid travelling through hose 362 is directed by fan nozzle 360 against the fan 120 thereby forcing any accumulated grease into the interior of the motor housing where it then drains down to tray 340. Drip catcher 364 acts to prevent any cleaning fluid that drips from nozzle 360 from falling on the cooking surface below, instead directing any cleaning fluid to the confines of the inner trough 345. As shown in FIG. 7, channel 395 travels from inner trough 345 through wall 348 and outer trough 346 to wall 342 where it combines with drainage hole 380. Drainage hole 382 is located on the opposite side of a partition wall 390, thereby allowing grease on that side of the tray to drain out of the range hood. Grease and used cleaning fluid drains through drainage holes 380 and 382 through hoses 327 (only one is shown) to external grease cups 326 (only one shown).

To access the motor housing interior, first lower panel 308 with integrated fan grill 338 must be removed from the remainder of the hood body 302. Using crips 290, hose 362 is removed from nozzle 360 before removing tray 340.

Figure 8:
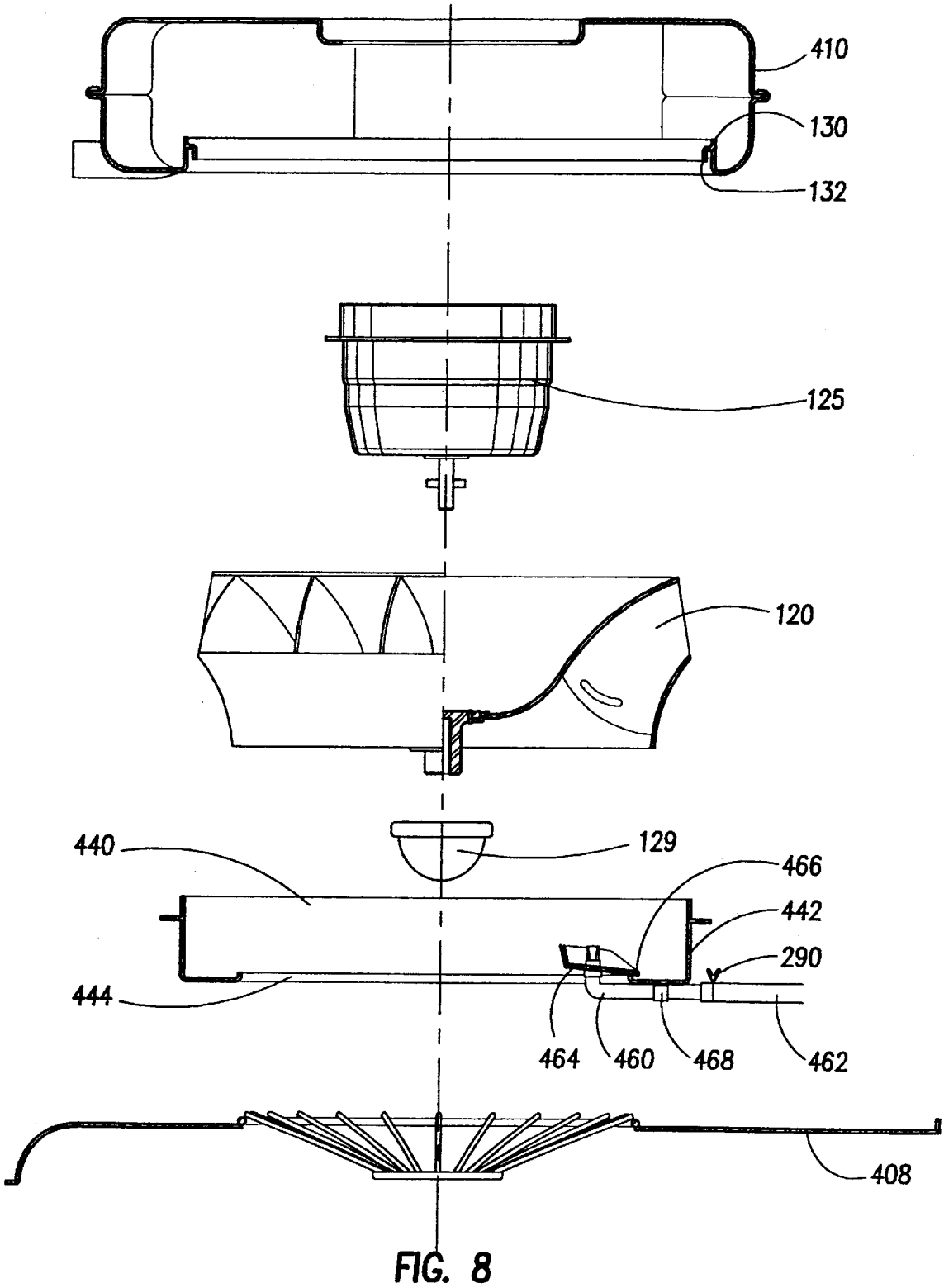
FIG. 8 is an exploded sectional view of portions of the range hood of FIG. 7

As is apparent from the three embodiments described above, the spray dispenser of the present invention may be adapted for various range hood and tray designs. This is shown in FIGS. 7 and 8, where a further alternative embodiment is shown. Motor housing 410 is similar in all respects to motor housing 110 except with respect to its size in relation to the motor 125 and fan 120. Motor housing 410 is compressed vertically, such that fan 120 sits approximately half in and half out of the motor housing 410 when it is connected to motor 125 by way of fan cap 129.

The tray 440 is similar to that of FIGS. 1 and 2, but is-simply dimensioned differently. Outer wall 444 extends a much greater distance vertically than does inner wall 442. Nozzle 460 may be releasably or permanently connected to the bottom of tray 440 by connector 468. Hose 462 may be connected to nozzle 460 by crip 290 and to a pump providing a source of cleaning fluid.

Further alternative embodiments of the invention are contemplated by combining different fan types with different motor housing and grease tray designs.

The spray dispenser may be activated in one of two ways. First, the range hood may be adapted such that the pump connected to the spray dispenser is automatically activated for a set period of time during range hood use. The duration of activity may be varied, however it preferably lasts for approximately 15 seconds. Alternatively, the pump of the fan cleaner may be activated manually. In this way, if the range hood is subjected to particularly greasy vapour on a given day, the fan cleaner may be activated manually in order to ensure that sufficient cleaning fluid is sprayed against the fans to force off all the accumulated grease.

Typically only a very small amount of grease accumulates on a fan as most is dispersed by means of the centripetal force of the rotating fan. However, any grease or liquid that remain on the fan will be forced to the interior of the housing by the cleaning fluid as discussed with respect to the various embodiments above. As a result of the grease being removed from the fan, very little grease accumulates in the trays, and they need only be checked, and cleaned if necessary, during regular maintenance of the range hood.

It will be appreciated by those skilled in the art that the preferred and alternative embodiments have been described in some detail but that certain modifications may be practiced without departing from the principles of the invention.

What is claimed is:

1. A spray dispenser for use in a range hood comprising a motor housing having an interior and containing at least one motor and at least one fan, and a grease tray releasably attachable to said motor housing, said spray dispenser comprising:

a nozzle;

a hose;

at least one source of cleaning fluid located externally to said motor housing;

said nozzle being positioned so as to disperse cleaning fluid from said source of cleaning fluid against said fan and into said motor housing interior; wherein:

said nozzle and hose are located external to said motor housing;

said grease tray comprises an opening, first second and third tray walls extending around said opening, a first trough formed between said first and second tray walls, a second trough formed between said second and third tray walls, and at least one drainage hole; and said nozzle extends through apertures in at least two of said first, second and third tray walls.

2. A spray dispenser for use in a range hood comprising a motor housing having an interior and containing at least one motor and at least one fan, and a grease tray releasably attachable to said motor housing, said spray dispenser comprising:

a nozzle;

a hose;

at least one source of cleaning fluid located externally to said motor housing;

said nozzle being positioned so as to disperse cleaning fluid from said source of cleaning fluid against said fan and into said motor housing interior;

wherein:

said grease tray comprises an opening, first, second and third tray walls extending around said opening, a first trough formed between said first and second tray walls, a second trough formed between said second and third tray walls, and at least one drainage hole; and said nozzle extends through apertures in at least two of said first, second and third tray walls.

3. The spray dispenser of claim 1 or 2 wherein said nozzle has a drip catcher.

4. The spray dispenser of claim 3 wherein said drip catcher is seated in said first trough.

5. A spray dispenser for use in a range hood comprising an outer hood body forming an enclosure within which is mounted a motor housing having an interior and containing at least one motor and at least one fan, and a grease tray releasably attachable to said motor housing, said spray dispenser comprising:

a nozzle;

a hose;

at least one source of cleaning fluid located externally to said motor housing; and wherein said nozzle is releasably connectable to said grease tray and is positioned so as to disperse cleaning fluid from said source of cleaning fluid against said fan and into said motor housing interior, said nozzle and hose being located within said enclosure formed by said hood body.

6. A spray dispenser for use in a range hood comprising a motor housing having an interior and containing at least one motor and at least one fan, and a grease tray releasably attachable to said motor housing, said spray dispenser comprising:

a nozzle;

a hose;

at least one source of cleaning fluid located externally to said motor housing;

said nozzle being positioned so as to disperse cleaning fluid from said source of cleaning fluid against said fan and into said motor housing interior; and wherein said grease tray comprises an opening, first and second tray walls extending around said opening, a trough formed between said walls and a gap in said first and second tray walls, said gap sized such that said nozzle fits within said gap.

7. A spray dispenser for use in a range hood generally defining an enclosure and comprising an upper panel and a lower panel, said lower panel having at least one air inlet and having a motor housing and tray, said motor housing being connectable to said range hood within said enclosure of said range hood, said motor housing generally defining a further enclosure and comprising a lower surface, said lower surface having at least one intake opening and at least one drain hole, said intake opening being defined by a wall depending from said lower surface and projecting into the interior of said further enclosure, said spray dispenser comprising:

a nozzle;

a hose;

at least one source of cleaning fluid located externally to said motor housing, wherein:

said tray comprises a tray opening, first and second tray walls extending around said tray opening, and a trough formed between said tray walls;

said air inlet is defined by a third wall depending from said lower panel and projecting into the interior of said range hood enclosure, said air inlet and said intake opening being of substantially identical shape and said air inlet being located directly below said intake opening;

said tray dimensioned to be Inserted into said air inlet and connected to said intake opening;

and said tray further comprising a gap in said first and second tray walls, said gap sized such that said nozzle is seated within said gap when said tray is inserted into said air inlet and connected to said intake opening.

8. A spray dispenser for use in a range hood generally defining an enclosure and comprising an upper panel and a lower panel, said lower panel having at least one air inlet and having a motor housing and tray, said motor housing being connectable to said range hood within said enclosure of said range hood, said motor housing generally defining a further enclosure and comprising a lower surface, said lower surface having at least one intake opening and at least one drain hole, said intake opening being defined by a wall depending from said lower surface and projecting into the interior of said further enclosure, said spray dispenser comprising:

a nozzle;

a hose;

at least one source of cleaning fluid located externally to said motor housing, wherein:

said tray comprises a tray opening, first and second tray walls extending around said tray opening, and a trough formed between said tray walls;

said tray is releasably connectable to said intake opening; and said nozzle is releasably connectable to said tray, said nozzle and hose being located within said enclosure formed by said hood body.

* * * * *